219-121
1/19/88 XR 4,720,312 SR

United States Patent [19]
Fukuizumi et al.

[11] Patent Number: 4,720,312
[45] Date of Patent: Jan. 19, 1988

[54] PROCESS FOR PRODUCING SURFACE REMELTED CHILLED LAYER CAMSHAFT

[75] Inventors: Toshiharu Fukuizumi; Hideo Nonoyama, both of Toyota, Japan

[73] Assignee: Toyota Jidosha Kabushiki Kaisha, Toyota, Japan

[21] Appl. No.: 894,828

[22] Filed: Aug. 8, 1986

[30] Foreign Application Priority Data

Aug. 8, 1985 [JP] Japan ..... 60-173113

[51] Int. Cl.[4] ..... C21D 9/30
[52] U.S. Cl. ..... 148/152; 148/902; 148/903; 219/121 LM
[58] Field of Search ..... 148/4, 13, 904, 903, 148/902, 151, 152, 145; 219/121 LM, 121 LE, 121 LF, 121 EB, 121 EF, 121 EG, 121 P, 121 PA, 121 PB, 121 R

[56] References Cited

U.S. PATENT DOCUMENTS 4,147,335 5/1979 Heck ..... 266/261

FOREIGN PATENT DOCUMENTS 53-94209 8/1978 Japan .
57-177926 11/1982 Japan .
59-23156 2/1984 Japan .
60-234168 11/1985 Japan .
60-234169 11/1985 Japan .

*Primary Examiner*—Melvyn J. Andrews
*Assistant Examiner*—S. Kastler
*Attorney, Agent, or Firm*—Oblon, Fisher, Spivak, McClelland & Maier

[57] ABSTRACT

A process for producing a surfactant remelted chilled layer camshaft with cams subjected to a remelting chilling treatment comprising steps of melting a sliding cam surface by irradiating a high density energy (e.g., a TIG arc) and forming a continuous chill layer by self-cooling. Then, at places where a formed molten metal pool may be caused to sag by the force of gravity, the melting action is interrupted to solidify the molten metal pool, and is resumed so as to overlap a former formed chill layer portion and a following chill layer portion.

5 Claims, 7 Drawing Figures

PROCESS FOR PRODUCING SURFACE REMELTED CHILLED LAYER CAMSHAFT

BACKGROUND OF THE INVENTION

1. Field of the Invention

The present invention relates to a camshaft with cams. More particularly, it relates to a process for producing a surface remelted chilled layer camshaft having an excellent wear-resistant chill layer formed by melting a sliding cam surface with a high density energy, such as a TIG arc, a laser beam, a plasma arc, or an electron beam, and chilling the molten portion by self-cooling.

2. Description of the Related Art

In a camshaft with cams fitted into an engine for an automobile and the like, an sliding cam surface of each of the cams must have a superior wear-resistance. Accordingly, the cam is subjected to a surface remelting treatment (i.e., surface hardening treatment) in which the sliding cam surface portion is melted by a high density energy, such as a TIG arc, a laser beam, or an electron beam, and is rapidly cooled by self-cooling to form a chill hardened layer (for example, cf. Japanese Unexamined Patent Publication (Kokai) Nos. 59-23156, 60-234168, and 60-234169 filed by the present applicant). When the surface remelted chilled layer camshaft is produced by using this surface remelting treatment, as shown in FIG. 1, a TIG arc 5 is generated between a cam 2 of a camshaft 1 and a tungsten electrode 4 of a TIG torch 3 to melt a sliding cam surface, and simultaneously, the camshaft 1 is rotated around its center axis 6 in a direction 7 and is oscillated (reciprocated) in parallel to the center axis 6. The torch 3 is moved in a vertical direction 9, with a constant distance (gap) being maintained between the tungsten electrode 4 and the surface of the cam 2. Note, the torch 3 can be oscillated instead of the camshaft 1.

FIG. 2 shows a cross section of the cam 2 of the camshaft 1, with the axis (Z-axis) 11 of the torch 3 intersecting the center axis 6 of the camshaft 1. At a melting point A, a tangential line 12 of a cam profile and the horizontal line 13 form a varying angle $\alpha$ (referred to as a sag angle). When the sag angle $\alpha$ is large, a problem arises in that a molten metal pool formed by a high density energy is caused to sag downward by the force of gravity. Generally, the sag angle $\alpha$ is at a maximum when an angle formed between the axis 11 of the torch 3 and a line connecting the cam nose point 14 to the center axis 6 of the camshaft 1 is from 15° to 30° (degrees). This maximum angle is formed at both sides of the cam nose point 14. One of these two positions will have the maximum sag angle during the melting by the TIG arc on a cam surface point from a base circle portion 15 of the cam 2 to the cam nose point 14 (in FIG. 2). In this case, under the melting position, a chill layer was formed by melting and then rapidly cooled by self-cooling, accordingly the chill layer retains a certain heat. This heat delays the solidification of a portion of the molten pool that is sagging due to the force of gravity. An arc will generate preferentially between a hot spot which was melted and solidified and the tungsten electrode, so that an arc column shifts downward from a line connecting the electrode and the center axis of the camshaft to the chill layer previously formed. The faster the rotational speed of the camshaft, the larger the shift of the arc column. Furthermore, a portion of an argon gas stream enclosing the arc column shifted from the line flows downward along the cam surface. Therefore the above-mentioned factors increase the sagging of the molten metal pool. On the other hand, at the other position having the maximum sag angle during the melting by the TIG arc on a cam surface portion from the cam nose point 14 to the base circle portion 15, the sag does not cause a problem. In this case, if the molten metal pool is caused to sag by the force of gravity, the sagging portion rapidly solidifies, since a portion of the cam under the melting position is still not heated and is cool. The arc column is shifted upward to the chill layer previously formed and continuing from the cam nose point 14, and portion of the argon gas stream enclosing the shifted arc column flows upward along the cam surface. Therefore, the influences of the heat and argon gas stream explained in the former case do not occur, so that the sagging does not increase.

Where a large sagging of the molten metal pool occurs, as shown in FIG. 3 which is a partial cross-sectional view of a cam taken along the center axis 6, an irregularity occurs on a cam surface (i.e., a surface of a chill layer 21). In FIG. 3, a martensite layer 22 is formed under the chill layer 21, and a matrix structure of the cam (an as-cast structure) 23 exists under the layer 22. After the surface remelting treatment using a TIG arc, the surface remelted chilled camshaft is subjected to grinding treatment so as to form ground surfaces of cams having a predetermined profile. When a cam with large irregular surface is ground, at a recess 24 deeper than a grinding margin t, a portion of the skin remains. Generally the grinding margin t is a difference between the treated cam surface and the ground surface 27 e.g., about 0.5 mm. In practice, the grinding margin varies in accordance with the capability of a machine tool prior to the surface hardening treatment. Taking the variation into consideration, in order to eliminate the defect of the remaining skin portion, it is necessary to make a depth of the recess in the treated cam surface to be within 0.25 mm from the cam surface 26. In order to ensure the depth of less than 0.25 mm in the recess caused by the sagging of the molten metal pool, when the sag angle $\alpha$ is 33°, an arc current is decreased (the irradiation energy is decreased) to decrease the amount of the molten metal pool, whereby a maximum chill depth becomes from 0.8 to 1.0 mm. However, the chill layer having the maximum chill depth of that value is likely to became unstable, even though the wear resistance of the chill layer is such that it passed various durability tests using an engine. Preferably, the maximum chill depth is more than 1.0 mm, more preferably, more than 1.5 mm.

In order to ensure such a large maximum chill depth (chill layer thickness), the surface remelting treatment (remelting chilling treatment) on the cam surface must be carried out by using a predetermined energy controlled to ensure that the sagging of the molten metal pool due to the force of gravity is reduced.

A proposal has been made that a sag angle $\alpha$ be constantly kept at 0° (zero degree), to minimize or prevent sagging of the molten metal pool due to the force of gravity. For example, according to a method for hardening a sliding cam surface disclosed in Japanese Unexamined Patent Publication (Kokai) No. 57-177926, a sliding cam surface portion including a nose portion between B to E in FIGS. 1 to 3 is always kept in a horizontal position (a sag angle $\alpha$ being approximately equal to zero). An apparatus for carrying out the proposed method requires a mechanism for eccentrically rotating a camshaft around a center axis of a small circle of the nose portion, and a mechanism for transferring a torch in a direction at right angles to the center axis of the camshaft. In recent years, to prevent abnormal wear at a base circle portion of the cam, the remelting chilling treatment is applied on the whole circumferential surface of the cam. However the apparatus is not provided with a mechanism for treating a base circle portion of the cam. If the remelting chilling treatment for carried, the base circle portion is the camshaft is rotated around a center axis of a large circle of the base circle portion (the center axis corresponding to the camshaft center axis), so that the apparatus is very complicated.

SUMMARY OF THE INVENTION

An object of the present invention is to improve an operating (controlling) method so as to reduce the sagging of the molten metal pool caused by the force of gravity, and an apparatus of a remelting chilling treatment for a camshaft by means of a conventional high density energy irradiation is utilized without undue alteration.

Another object of the present invention is to provide a method for producing a surface remelted chilled layer camshaft, which method makes a depth of a recess caused by the sagging of the molten metal pool less than 0.25 mm and ensures a maximum chill depth of more than 1.0 mm in a cross section taken in a cam width direction on the whole circumferential surface of the cam.

These and other objects of the present invention are attained by a process for producing a camshaft with cams subjected to a remelting chilling treatment comprising the steps of melting a sliding cam surface of the each of the cams by irradiating a high density energy, and forming a continuous chill layer by self-cooling, which process is characterized in that, at places where a molten metal pool is liable to be caused to sag by the force of gravity, the melting action is interrupted to solidify the molten metal pool and is resumed so as to overlap a former formed chill layer portion and a following chill layer portion.

The interruption of the melting action is carried out by lowering the high density energy from a melting level to an nonmelting level to allow solidification (e.g., by decreasing a current for a TIG arc to an nonmelting current level) and, simultaneously, temporarily stopping or reversing a rotation of the camshaft around its axis.

BRIEF DESCRIPTION OF THE DRAWINGS

The present invention will become more apparent from the description of the preferred embodiments set forth below with reference to the accompanying drawings, in which.

DESCRIPTION OF THE PREFERRED EMBODIMENTS

Figure 4:
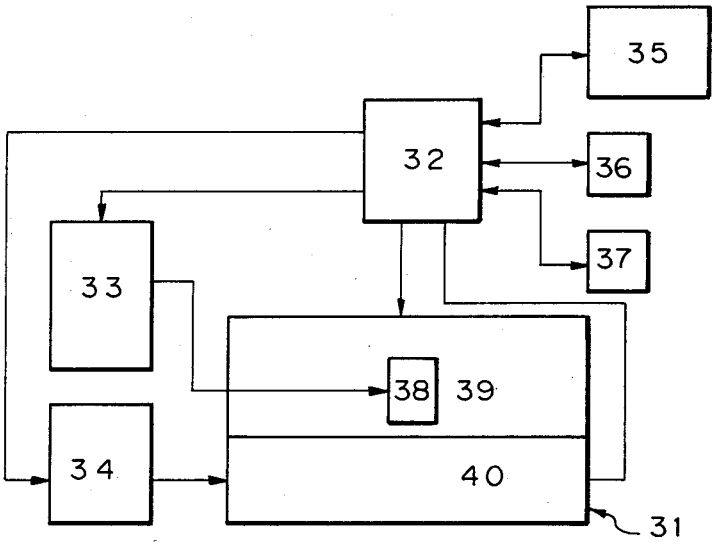
FIG. 4 is a block diagram of a control system of an apparatus for the remelting and chilling treatment.
Figure 5:
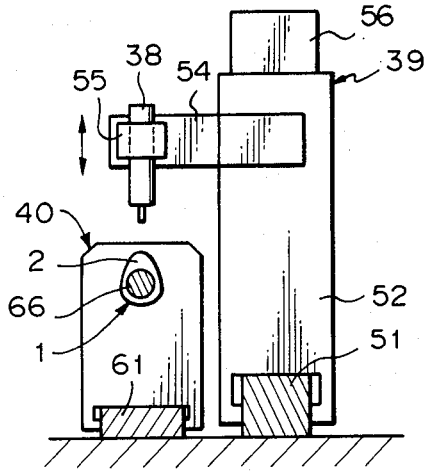
FIG. 5 is a sectional side view of a mechanical portion of the apparatus for the remelting and chilling treatment, taken along the line V—V of FIG. 6.
Figure 6:
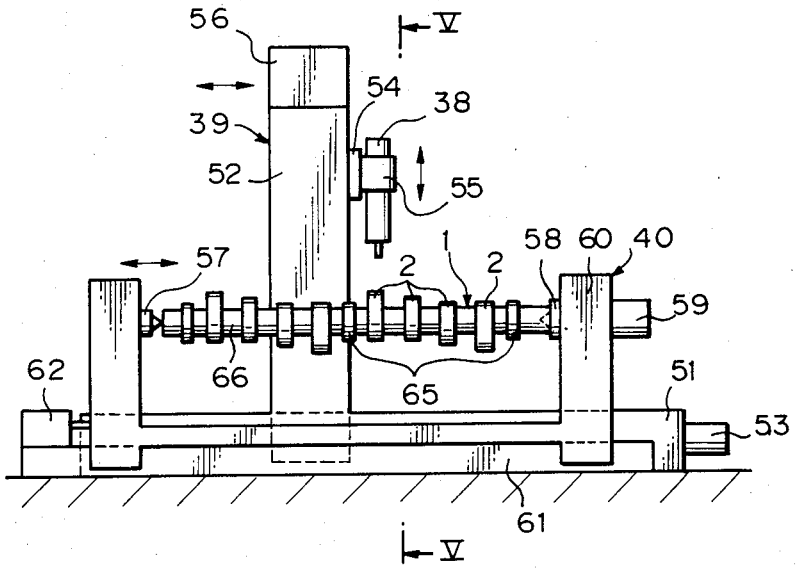
FIG. 6 is a front view of the mechanical portion of the apparatus for the remelting and chilling treatment.

Referring to FIGS. 4, 5 and 6, an apparatus for carrying out the process for producing a remelted and chilled camshaft according to the present invention will be now explained. A control system of the apparatus is shown in FIG. 4. A mechanical portion of the apparatus is shown in FIGS. 5 and 6, and has a construction basically the same as a conventional construction.

The apparatus of the remelting and chilling treatment comprises a control unit and the mechanical portion (unit) 31. The control unit comprises a controller 32, a high density energy source (an electric source for a TIG arc) 33, a control device 34 for oscillation of the camshaft, a programming unit 35, a teaching unit 36, and an operating board 37. The mechanical portion 31 comprises a high density energy irradiator (TIG torch) 38, a robot portion 39 for moving the torch in the directions of the X-axis and Z-axis intersecting each other at right angles, and a driving portion 40 for carrying, rotating, and oscillating a camshaft. In this example, the camshaft is oscillated, but the torch can be oscillated instead of the camshaft.

The electric source 33 for the TIG arc preferably feeds a melting current for a direct current TIG arc which is periodically varied and has a wave-form similar to a current wave-form in so-called TIG pulse welding. This pulse current has a base current (background current) which can generate a TIG arc for melting a cam surface so that a molten metal pool is continuously formed. According to the present invention, the electric source 33 for the TIG arc is provided with a circuit changing unit for changing the melting current to an nonmelting current, which generates a TIG arc but does not melt the cam surface, to allow the molten metal pool to slowly solidify. Preferably, the melting current has a base current of from 60 to 140 A, to obtain a maximum chill depth of more than 1.0 mm. If the base current is more than 140 A, the melt quantity is large and brings about the problem of sagging. Preferably a peak value and a pulse width (duration) of the pulse current are suitably set to from 70 to 150 A and from 0.1 to 0.4 seconds, respectively.

The robot portion 39 having two moving directions along the X-axis and Z-axis intersecting each other at right angles comprises a slide base 51, a sliding column 52, and a sliding column drive 53, which transfers a torch 38 in an X-axis direction parallel to the center axis 6 of a camshaft 1. To transfer the torch 38 in a vertical Z-axis direction at right angles to the center axis 6, the sliding column 52 is provided with a movable plate 54 in the Z-axis direction, a fixture 55 for attaching the torch 38 to the movable plate 54, and a movable plate drive 56. The driving portion 40 for a workpiece (camshaft) comprises a rotating portion 60, a slide base 61, and an oscillating drive 62. The rotating portion 60 has centers 57 and 58 holding the camshaft 1 and a drive (servomoter) 59 for rotating the camshaft. The oscillating drive 62 oscillates (reciprocates) the rotating portion 60 in the X-axis direction on the slide base 61. Certain commands are transmitted from the controller 32 to the sliding column drive 53, the movable plate drive 56, the camshaft rotating drive 59, and the electric source 33 including the circuit changing unit, and other commands are transmitted to the oscillating drive 62 via the oscillation control device 34. In order to carry out the remelting chilling treatment for the camshaft in accordance with the process of the present invention, optimum operating conditions are set up by means of the programming unit 35, the teaching unit 36, and the operating board 37, and accordingly, the treatment apparatus is automatically operated by the controller 32.

The above-mentioned remelting chilling treatment apparatus is operated in the following manner in Examples 1 to 5 so as to produce a camshaft.

EXAMPLE 1

Figure 1:
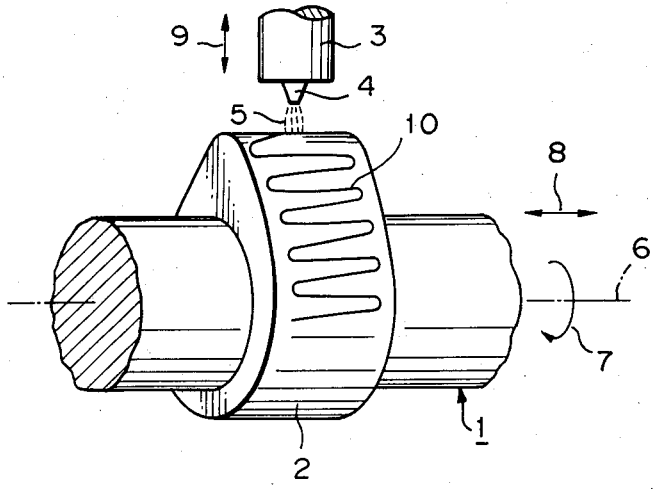
FIG. 1 is a schematic view of a cam of a camshaft and a TIG arc torch.
Figure 2:
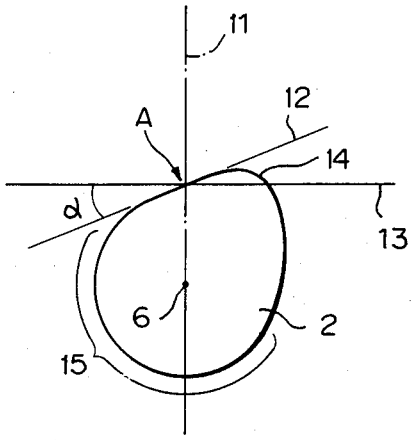
FIG. 2 is a schematic sectional view of a cam, illustrating a sag angle $\alpha$.
Figure 3:
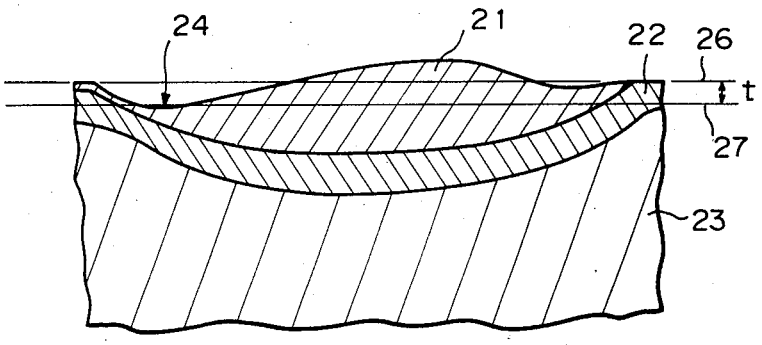
Fig. 3 PRIOR ART
FIG. 3 is a sectional partial view of a cam having an irregular surface caused by the sagging of a molten metal pool.

A camshaft 1 to be treated is set between the centers 57 and 58 of the rotating portion 60, as shown in FIG. 6. The camshaft 1 comprises, for example, cams 2, bearing journals 65, and a shaft body 66, and is made of special cast iron and has the following dimensions:

Total camshaft length: 400 mm
Cam width: 14.4 mm
Diameter of base circular portion: 31 mm
Lifting height: 8 mm The torch 38 is adjusted and fixed by the fixture 55 so that the axis thereof (i.e. Z-axis 11) intersects the center axis 6 of the camshaft 6 and is vertical (FIGS. 2 and 5). When generating the TIG arc, it is necessary to maintain a constant shortest distance (gap) between the cam surface and a tungsten electrode of the torch 38, and accordingly, a cam profile is premeasured by means of a sensor (using a ball having a diameter of 4 mm) and an electromagnetic micrometer and is stored in the memory of the program unit 36. The sliding column 52 is transferred in the X-axis direction by the drive 53 to bring the torch 38 just above the predetermined cam 2.

Next is a TIG arc is generated between the torch 38 and the cam surface for melting the cam. At the beginning, the camshaft is cool i.e., not preheated. If the cam is instantly melted by the TIG arc and a chill layer then formed, extreme thermal stress is apt to occur between the chill layer portion including the melted portion and the adjoining nonheated portion, which may cause cracking. To prevent such cracking, the cam is heated by the TIG arc prior to the rotation of the camshaft. The heating step is carried out by controlling the arc current value, first to a preheating level and then to the melting level, for about 4 seconds, while oscillating the camshaft in the center axis (X-axis) direction at a cycle of 1.0 second and an amplitude of 9.5 mm.

Thereafter the rotation of the camshaft 1 is started, and the cam 2 is subjected to the remelting chilling treatment using the TIG arc under the following conditions:

Camshaft rotation speed: 340°/min
DC pulse current for melting
  Base current: 115 A
  Pulsed peak current: 125 A
  Pulse duration: 0.2 seconds
Arc length: 2.0±0.1 mm
Camshaft oscillation speed: 60 cycles/min
Oscillation width of camshaft: 9.5 mm Note, when the entire circumferential cam surface is treated under the above-mentioned conditions without varying, a large sagging of a molten metal pool is caused by the force of gravity so that a defect in the remaining skin portion at a recess on the cam surface occurs after the grinding treatment.

Figure 7:
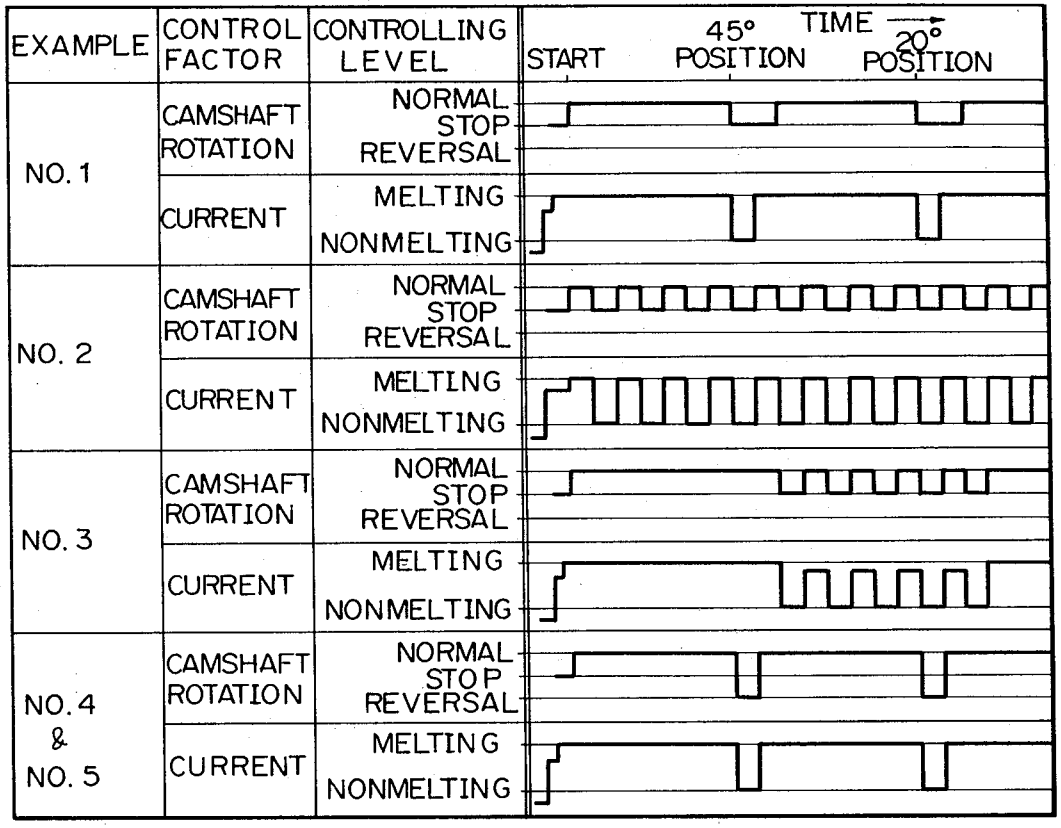
FIG. 7 is a graph showing variations of a rotation of a camshaft and an arc current in a embodiments of the process according to the present invention.

The cam 2 of the camshaft 1 has a point (position) of a minimum sagging angle $\alpha$ of 33° between the base circle portion and the cam nose portion, at which the sagging will cause a problem. At this point, a line connecting the nose point to the camshaft center axis and the axis line of the torch makes an angle (referred to as an angle from the nose) of 20°. When the angle from the nose is 20° and 45°, in accordance with the present invention, the camshaft rotation and the current are controlled (changed) in the manner shown in Example 1 in FIG. 7. Namely, when a cam surface point corresponding to the position at the angle from the nose of 45° comes under the torch, the rotation is stopped and, simultaneously, the current is changed (lowered) from a melting level to a nonmelting level, i.e., from 10 to 20 A, to solidify the molten metal pool. After one second the current is restored to the melting level and the melting by the TIG arc is carried out for one second to continue with the chill layer. Thus, the rotation is stopped for 2 seconds, and thereafter, the camshaft rotation is resumed. At the point of the maximum sag angle corresponding to the position at the angle from the nose of 20°, the same control as the above-mentioned control at the 20° position is carried out. As a result, at the point of the maximum sag angle on the cam surface, the depth of the recess in the irregular surface caused by the sagging can be made less than 0.25 mm, and the maximum chill depth in a cross section taken in the cam width direction can be made from 1.0 to 1.2 mm. Therefore, it is possible to make the chill depth (chill layer thickness) larger than in a conventional case by about 0.2 mm. When the melting of the TIG arc is temporarily stopped, a slight flow of the molten metal pool having a diameter of about 4 mm occurs due to the oscillation and rotation of the camshaft. Thus one of two recesses formed at both sides of a convex portion at the center in the cam width direction is deeper than the other.

EXAMPLE 2

A camshaft and the apparatus for the remelting chilling treatment are prepared in a similar manner to Example 1. When the remelting chilling treatment is carried out by generating the TIG arc with the melting level current and rotating the camshaft, the camshaft rotation is intermittently performed with stepwise feeds and the change of the current from the melting level to the nonmelting level and vice versa is performed synchronously with the motion of the camshaft in the manner shown in Example 2 in FIG. 7. The entire circumferential cam surface is treated under the following conditions:

Camshaft rotation speed: 300°/min
Stepwise feed of camshaft: one second rotation one second stoppage
Oscillation speed: 1.0 second/cycle
Oscillation width: 9.5 mm
DC pulse current for melting
  Base current: 115 A
  Pulsed peak current: 125 A
  Pulse duration: 0.2 seconds
DC current for nonmelting: 10–20 A
Time interval of current change: 1 second As a result of the above remelting chilling treatment, the sagging at the maximum sag angle point is smaller than in Example 1. The recess depth can be made less than 0.25 mm and the maximum chill depth can be made from 1.3 to 1.6 mm. But, in this case, the treating time is about double that of the conventional method, and the productivity is reduced.

EXAMPLE 3

In Example 2, a treating time was relatively long. To shorten this treating time, the intermittent rotation and the current change are performed for a predetermined period within a range of the angle from the nose of from 40° to 10°, in the manner shown in Example 3 in FIG. 7.

The cam surface portion from the base circle portion to the position at the angle from the nose of 40° is continuously subjected to the remelting chilling treatment under the following conditions:

Camshaft rotation speed: 340°/min
Oscillation speed: 1.0 second/cycle
Oscilation width: 9.5 mm
DC pulse current for melting
Base current: 120 A
Pulsed peak current: 130 A
Pulse duration: 0.2 seconds Next the cam surface portion between the 40° position and another position at the angle from the nose of 10° is subjected to the remelting chilling treatment with intermittent melting under the condition explained in Example 2.

Thereafter the remaining surface portion from the 10° position to the starting position including the base circle portion is continuously subjected to the treatment under the same conditions as the former conditions explained in this example.

As a result of the above-mentioned remelting chilling treatment, the sagging at the maximum sag angle point is the same as that of Example 2, and the recess depth (of less than 0.25) and maximum chill depth (of from 1.3 to 1.6 mm) are the same as those of Example 2.

EXAMPLE 4

The remelting chilling treatment of Example 1 is developed for preventing one of the two formed recesses from becoming deeper than the other recess depth. As shown in Example 4 of FIG. 7, when the angle from the nose becomes 45° and 20°, the TIG current is changed from the melting level to the nonmelting level and, simultaneously, the rotation of the camshaft is temporarity reversed. This interruption of the melting action and the counterrotation of the camshaft allow the previously solidified portion to be remelted, which contributes to the decrease of the recess depth for improving the irregularity of the surface, i.e., normalize the irregular surface.

The cam surface except the 45° position and the 20° position is subjected to the remelting chilling treatment under the same conditions as those of the continuous (constant) treatment explained in Example 2. At the 45° position and the 20° position, the camshaft is counterrotated and the current is changed to the nonmelting level of from 10 to 20 A for one second. When the counterrotation speed is 160°/min, the amount of counterrotation corresponds to an angle of about 2°. Accordingly, the molten metal pool is solidified, and due to the counterrotation, the chill layer portion corresponding to a pass line before the last pass line is returned under the torch. Thereafter, the camshaft rotation and the current are restored to the normal rotation and the melting level.

As a result, the depths of the two recesses in the irregular cam surface caused by the sagging at the maximum sagging angle position are almost equal to each other. Although the melting level current is higher than that of Example 1, by 5 A, the depth of recess is similar to that of Example 1. The maximum chill depth is from 1.2 to 1.4 mm.

EXAMPLE 5

In relation to the operation of Example 4, in order to increase the maximum chill depth, a low frequency pulse having a pulse duration of 0.2 seconds in the pulsed peak current is overlapped with a high frequency pulse of 15 kHz, and the normal rotation speed of the camshaft is changed to 300°/min. The remelting chilling treatment is carried out under the conditions of Example 4 except for the above-mentioned two factors. The overlapping of the high frequency pulse on the low frequency pulse allows the molten metal pool to become deeper and the extent of the effect of the TIG arc on the cam surface to become smaller. As the result, the depth of the recess in the irregular can surface at the maximum sag angle position is less than 0.25 mm, similar to that of Example 4, and the maximum chill depth is from 1.5 to 1.7 mm.

As mentioned above, the process for producing a remelted and chilled camshaft by using the TIG arc according to the present invention can reduce the sagging of the molten metal pool caused by the force of gravity and increase the maximum chill depth.

It will be obvious that the present invention is not restricted to the above-mentioned embodiments and that many variations are possible for persons skilled in the art without departing from the scope of the invention. For example, the TIG arc is used as an energy source in Example 1 to 5, but a laser beam, a plasm arc, or an electron beam can be used for producing the remelting and chilled camshaft in accordance with the present invention.

We claim:

1. A process for producing a camshaft with cams subjected to a remelting chilling treatment comprising steps of melting a sliding cam surface of each of said cams by irradiating with a high density energy, and forming a continuous chill layer by self-cooling, wherein at places where a molten metal pool formed during the melting may be caused to sag by the force of gravity, the melting action is interrupted to solidify the molten metal pool and is resumed so as to overlap a former formed chill layer portion and a following chill layer portion, wherein said former formed chill layer portion includes a portion immediately contiguous said places where the melting action is interrupted.

2. A process according to claim 1, wherein said interruption of the melting action is carried out by lowering the high density energy to an nonmelting level and, simultaneously, temporarily stopping a rotation of said camshaft around its axis.

3. A process according to claim 1, wherein said interruption of the melting action is carried out by lowering the high density energy to the nonmelting level and, simultaneously, temporarily reversing a rotation of said camshaft around its axis.

4. A process according to claim 1, wherein when said camshaft is intermittently rotated around its axis, said interruption of the melting action is carried out by lowering the high density energy bringing about the melting during the rotation to nonmelting level while the rotation is stopped.

5. A process according to claim 1, wherein said high density energy is a TIG arc, a laser beam, a plasma arc or an electron beam.

* * * * *